US006694933B1

(12) United States Patent
Lester

(10) Patent No.: US 6,694,933 B1
(45) Date of Patent: Feb. 24, 2004

(54) LOST MOTION SYSTEM AND METHOD FOR FIXED-TIME VALVE ACTUATION

(75) Inventor: John J. Lester, West Hartford, CT (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 10/246,670

(22) Filed: Sep. 19, 2002

(51) Int. Cl.[7] ..... F01L 9/02

(52) U.S. Cl. ..... 123/90.12; 123/90.11; 123/90.15; 123/198 F

(58) Field of Search ..... 123/90.11–90.16, 123/320–322, 198 F

(56) References Cited

U.S. PATENT DOCUMENTS 5,829,397 A * 11/1998 Vorih et al. ..... 123/90.12
5,996,550 A * 12/1999 Israel et al. ..... 123/322
6,257,183 B1 * 7/2001 Vorih et al. ..... 123/90.12

* cited by examiner

*Primary Examiner*—Thomas Denion
*Assistant Examiner*—Kyle Riddle
(74) *Attorney, Agent, or Firm*—Collier Shannon Scott, PLLC; Mark W. Rygiel

(57) ABSTRACT

The present invention relates generally to a system and method for actuating one or more valves in an internal combustion engine. In particular, the present invention relates to a system and method that may provide lost motion valve actuation of intake, exhaust, and auxiliary valves in an internal combustion engine.

23 Claims, 6 Drawing Sheets

LOST MOTION SYSTEM AND METHOD FOR FIXED-TIME VALVE ACTUATION

FIELD OF THE INVENTION

The present invention relates generally to a system and method for actuating one or more valves in an internal combustion engine. In particular, the present invention relates to a system and method that may provide lost motion valve actuation of intake, exhaust, and auxiliary valves in an internal combustion engine.

BACKGROUND OF THE INVENTION

Valve actuation in an internal combustion engine is required in order for the engine to produce positive power, as well as to produce engine braking. During positive power, one or more intake valves may be opened to admit fuel and air into a cylinder for combustion. One or more exhaust valves may be opened to allow combustion gas to escape from the cylinder. Intake, exhaust, and/or auxiliary valves may also be opened during positive power at various times to recirculate gases for improved emissions.

Engine valve actuation also may be used to produce engine braking and exhaust gas recirculation when the engine is not being used to produce positive power. During engine braking, one or more exhaust valves may be selectively opened to convert, at least temporarily, the engine into an air compressor. In doing so, the engine develops retarding horsepower to help slow the vehicle down. This can provide the operator with increased control over the vehicle and substantially reduce wear on the service brakes of the vehicle.

Engine valve(s) may be actuated to produce compression-release braking and/or bleeder braking. The operation of a compression-release type engine brake, or retarder, is well known. As a piston travels upward during its compression stroke, the gases that are trapped in the cylinder are compressed. The compressed gases oppose the upward motion of the piston. During engine braking operation, as the piston approaches the top dead center (TDC), at least one exhaust valve is opened to release the compressed gases in the cylinder to the exhaust manifold, preventing the energy stored in the compressed gases from being returned to the engine on the subsequent expansion down-stroke. In doing so, the engine develops retarding power to help slow the vehicle down. An example of a prior art compression release engine brake is provided by the disclosure of the Cummins, U.S. Pat. No. 3,220,392 (November 1965), which is incorporated herein by reference.

The operation of a bleeder type engine brake has also long been known. During engine braking, in addition to the normal exhaust valve lift, the exhaust valve(s) may be held slightly open continuously throughout the remaining engine cycle (full-cycle bleeder brake) or during a portion of the cycle (partial-cycle bleeder brake). The primary difference between a partial-cycle bleeder brake and a full-cycle bleeder brake is that the former does not have exhaust valve lift during most of the intake stroke.

In many internal combustion engines, the engine cylinder intake and exhaust valves may be opened and closed by fixed profile cams, and more specifically by one or more fixed lobes which may be an integral part of each of the cams. Benefits such as increased performance, improved fuel economy, lower emissions, and better vehicle drivability may be obtained if the intake and exhaust valve timing and lift can be varied. The use of fixed profile cams, however, can make it difficult to adjust the timings and/or amounts of engine valve lift to optimize them for various engine operating conditions, such as different engine speeds.

One method of adjusting valve timing and lift, given a fixed cam profile, has been to provide valve actuation that incorporates a "lost motion" system in the valve train linkage between the valve and the cam. Lost motion is the term applied to a class of technical solutions for modifying the valve motion proscribed by a cam profile with a variable length mechanical, hydraulic, and/or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve(s), and when contracted fully, transmit none or a minimum amount of the cam motion to the valve. An example of such a system and method is provided in Hu, U.S. Pat. Nos. 5,537,976 and 5,680,841, which are assigned to the same assignee as the present application and which are incorporated herein by reference.

In the lost motion system of U.S. Pat. No. 5,680,841, an engine cam shaft may actuate a master piston which displaces fluid from its hydraulic chamber into a hydraulic chamber of a slave piston. The slave piston in turn acts on the engine valve to open it. The lost motion system may include a solenoid valve and/or a check valve in communication with the hydraulic circuit including the chambers of the master and slave pistons. The solenoid valve may be maintained in a closed position in order to retain hydraulic fluid in the circuit when the master piston is acted on by certain of the cam lobes. As long as the solenoid valve remains closed, the slave piston and the engine valve respond directly to the hydraulic fluid displaced by the motion of the master piston, which in turn displaces hydraulic fluid in direct response to the cam lobe acting on it. When the solenoid is opened, the circuit may drain, and part or all of the hydraulic pressure generated by the master piston may be absorbed by the circuit rather than be applied to displace the slave piston, and correspondingly, the engine valve.

Some previous lost motion systems have utilized high speed mechanisms to rapidly vary the length of the lost motion system. By using a high speed mechanism to vary the length of the lost motion system, precise control may be attained over valve actuation, and accordingly optimal valve actuation may be attained for a wide range of engine operating conditions. Systems utilizing high speed control mechanisms, however, can be costly to manufacture and operate.

When a unitary cam lobe is used to impart the valve motion for both an auxiliary valve event (e.g., engine braking) and the main valve event (e.g., main exhaust), there may be increased overlap between the main intake and exhaust events. The use of a unitary lobe for both events means that the relatively large main event lobe motion will be imparted to the valve actuation system. Because there may be little or no lash between the valve actuation system and the engine valve during engine braking, input of the main event motion may produce a greater than desired main exhaust event. The time during the cycle when both intake and exhaust valves are open at the same time may be increased. The longer that both the intake and exhaust valves are open together, the more exhaust manifold pressure is likely to bleed through the open intake valve. This may greatly reduce braking performance. As such, there is often a need for a valve actuation system including a "reset" mechanism, such that, when a unitary cam lobe is used to impart the valve motion, the valve experiences normal lift and closing during engine braking.

The design, size, and configuration of many engines require valve actuation systems to be located relatively remote from the engine valves that they are required to actuate (e.g., on the input side of an engine rocker arm), rather than being located on the valve side of the engine. Production tolerances for components on the input side of an engine rocker arm (e.g., the push tube) are typically much greater than those on the valve side because the manufacturer may anticipate making manual lash adjustments. Incorporating valve actuation systems capable of providing precise lost motion and/or reset functionality in this location may be difficult due to the inherent production tolerances that may exist between the valve actuation system and the valves.

The lost motion systems and methods of the present invention may be particularly useful in engines requiring lost motion valve actuation for positive power, engine braking valve events (such as, for example, compression release and bleeder braking), and/or exhaust gas recirculation valve events. The systems of various embodiments of the present invention may provide a lower cost, production viable lost motion circuit with fixed event timing that requires no high speed electronic controls to operate. In addition, the systems and methods of the present invention may reduce valve overlap during braking and reduce the impact on the valve train.

Additional advantages of embodiments of the invention are set forth, in part, in the description which follows and, in part, will be apparent to one of ordinary skill in the art from the description and/or from the practice of the invention.

SUMMARY OF THE INVENTION

Responsive to the foregoing challenges, Applicant has developed innovative systems and methods for actuating one or more engine valves. In one embodiment, the present invention is an engine valve actuation system comprising: a lost motion subsystem operatively connected to the engine valve; a hydraulic fluid supply in communication with the lost motion subsystem; and means for imparting motion to the lost motion subsystem. The lost motion subsystem may comprise: a housing having an internal bore; a piston assembly slidably disposed in the bore, the piston assembly comprising a master piston and a slave piston; a hydraulic control valve; a solenoid actuated hydraulic fluid valve; a first hydraulic passage connecting the control valve to the piston assembly; a second hydraulic passage connecting the fluid supply to the control valve; and a third hydraulic passage connecting the solenoid valve to the control valve.

In another embodiment, the present invention is a method of actuating an engine valve during first and second operating modes to produce a main event valve actuation and to selectively produce an auxiliary event valve actuation using motion imparted to a lost motion subsystem. The method may comprise the steps of: supplying hydraulic pressure to the lost motion subsystem; during the first operating mode, selectively absorbing at least a portion of the hydraulic pressure applied to the lost motion subsystem so as to selectively lose a portion of the motion imparted thereto; and during the second operating mode, creating a hydraulic lock in the lost motion subsystem to transfer the motion to the engine valve and selectively modifying the manner in which the motion is transferred to the valve from hydraulic means to mechanical means.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of this invention, reference will now be made to the appended drawings, in which like reference numerals refer to like elements. The drawings are exemplary only, and should not be construed as limiting the invention.

DETAILED DESCRIPTION OF PREFERRED EMBODIMENTS OF THE INVENTION

Reference will now be made in detail to a first embodiment of the system and method of the present invention, an example of which is illustrated in the accompanying drawings. As embodied herein, the present invention includes systems and methods of controlling the actuation of engine valves.

Figure 1:
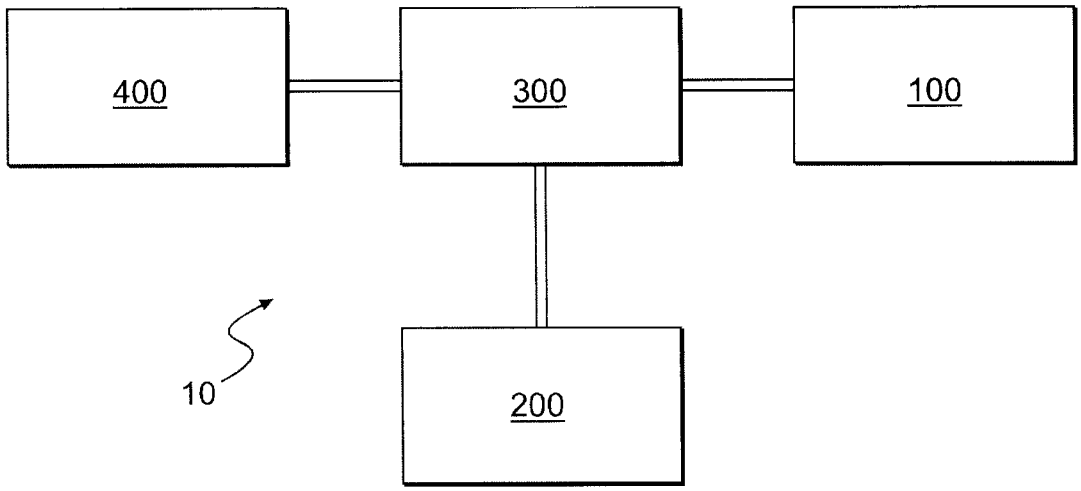
FIG. 1 is a block diagram of a valve actuation system according to a first embodiment of the present invention.

An embodiment of the present invention is shown in FIG. 1 as valve actuation system 10. The valve actuation system 10 includes a lost motion subsystem or variable length system 300 which connects a means 100 for imparting motion with one or more engine valves 200. The motion imparting means 100 provides an input motion to the lost motion system 300. The lost motion system 300 may be selectively switched between modes of: (1) losing a portion of the motion input by the motion imparting means 100, and (2) transferring the input motion to the engine valves 200. In this manner, the motion transferred to the engine valves 200 may be used to produce various engine valve events, such as, but not limited to, main intake, main exhaust, compression release braking, bleeder braking, and/or exhaust gas recirculation. The valve actuation system 10, including the lost motion system 300, may be switched between a mode of losing motion and not losing motion in response to a signal or input from a control means 400. Without limiting the scope of the present invention, the remainder of this detailed description will refer to the mode of not losing motion as engine braking. The engine valves 200 may be exhaust valves, intake valves, and/or auxiliary valves.

The motion imparting means 100 may comprise any combination of cam(s), cam follower(s), push tube(s), and/or rocker arm(s), or their equivalents. The lost motion system 300 may comprise any structure that connects the motion imparting means 100 to the valves 200 and is capable of transmitting motion from the motion imparting means 100 to the valve 200. In one sense, the lost motion system 300 may be any structure(s) capable of selectively attaining more than one length. The lost motion system 300 may comprise, for example, a mechanical linkage, a hydraulic circuit, a hydro-mechanical linkage, an electromechanical linkage, and/or any other linkage adapted to connect to the motion imparting means 100 and attain more than one operative length. The lost motion system 300 may include means for adjusting the pressure, or amount of fluid in the hydraulic circuit, such as, for example, trigger valve(s), check valve(s), accumulator(s), and/or other devices used to release hydraulic fluid from or add hydraulic fluid to a circuit in the lost motion system 300. The lost motion system 300 may be located at any point in the valve train connecting the motion imparting means 100 and the valves 200. In a preferred embodiment, the lost motion system 300 is located on the push tube side of the engine, as described below.

The control means 400 may comprise any electronic and/or mechanical device for communicating with the lost motion system 300 and selectively causing the lost motion system 300 to either lose a portion of the motion input to it, or not lose motion. The control means 400 may include a microprocessor, linked to an appropriate vehicle component(s), to determine and select the appropriate mode of the lost motion system 300. The vehicle component may include, without limitation, an engine speed sensing means, a clutch position sensing means, a fuel position sensing means, and/or a vehicle speed sensing means. Under prescribed conditions, the control means 400 will produce a signal and transmit the signal to the lost motion system 300, which will, in turn, switch to the appropriate mode of operation. For example, when the control means 400 determines that engine braking mode is desired, based on a condition, such as, idle fuel, engaged clutch, and/or an engine RPM greater than a certain speed, the control means 400 may produce and transmit a signal to the lost motion system 300 to switch to engine braking mode. It is contemplated that the valve actuation system 10 is designed such that valve actuation may be optimized at one or more engine speeds and engine operating conditions.

Figure 2A:
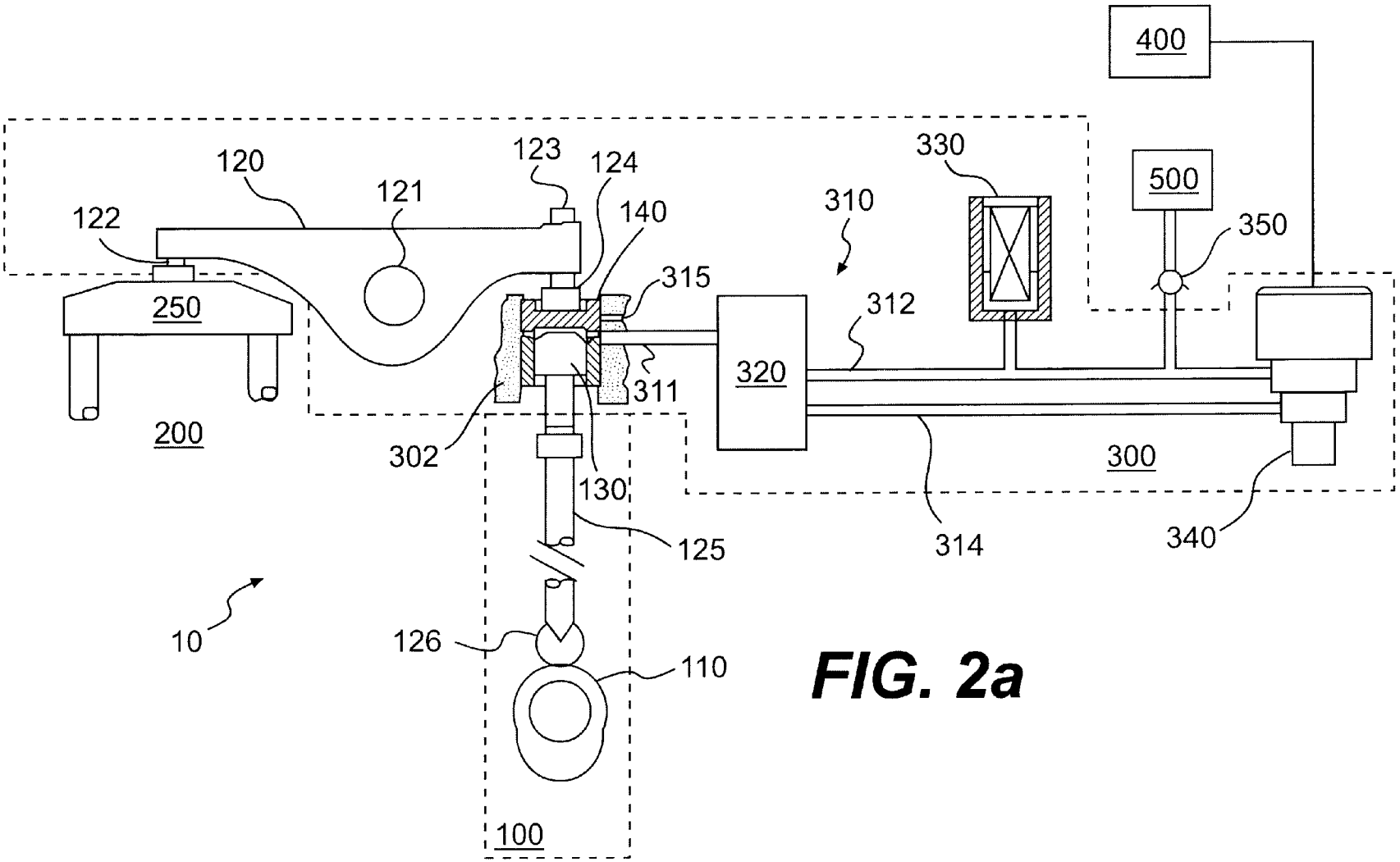
FIG. 2*a* is a schematic diagram of a valve actuation system according to a second embodiment of the present invention.

Another embodiment of the present invention is shown in FIG. 2*a*. With reference thereto, the motion imparting means 100 may comprise a cam 110, and a push tube assembly 125. The motion imparting means 100 is adapted to act on the lost motion system 300, as shown in FIG. 2*a*.

Figure 3:
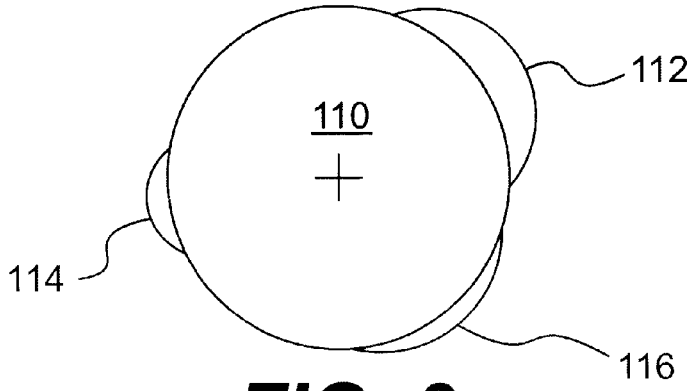
FIG. 3 is a schematic diagram of a cam having multiple lobes for use in connection with various embodiments of the present invention.

The cam 110 may include one or more cam lobes for producing an engine valve event. With reference to FIG. 3, the cam lobes may include lobes, such as, for example, a main (exhaust or intake) event lobe 112, an engine braking lobe 114, and an EGR lobe 116. The depictions of the lobes on the cam 110 are intended to be illustrative only, and not limiting. It is appreciated that the number, combination, size, location, and shape of the lobes may vary markedly without departing from the intended scope of the invention. For example, the engine braking lobe 114 may be shaped to produce a bleeder braking event or a compression release braking event.

The lost motion system 300 may include a housing 302, a master piston assembly 130, a slave piston assembly 140, a rocker 120, a hydraulic circuit 310 formed within the housing 302, a control valve 320, an accumulator 330, and a solenoid actuated valve 340.

Figure 2B:
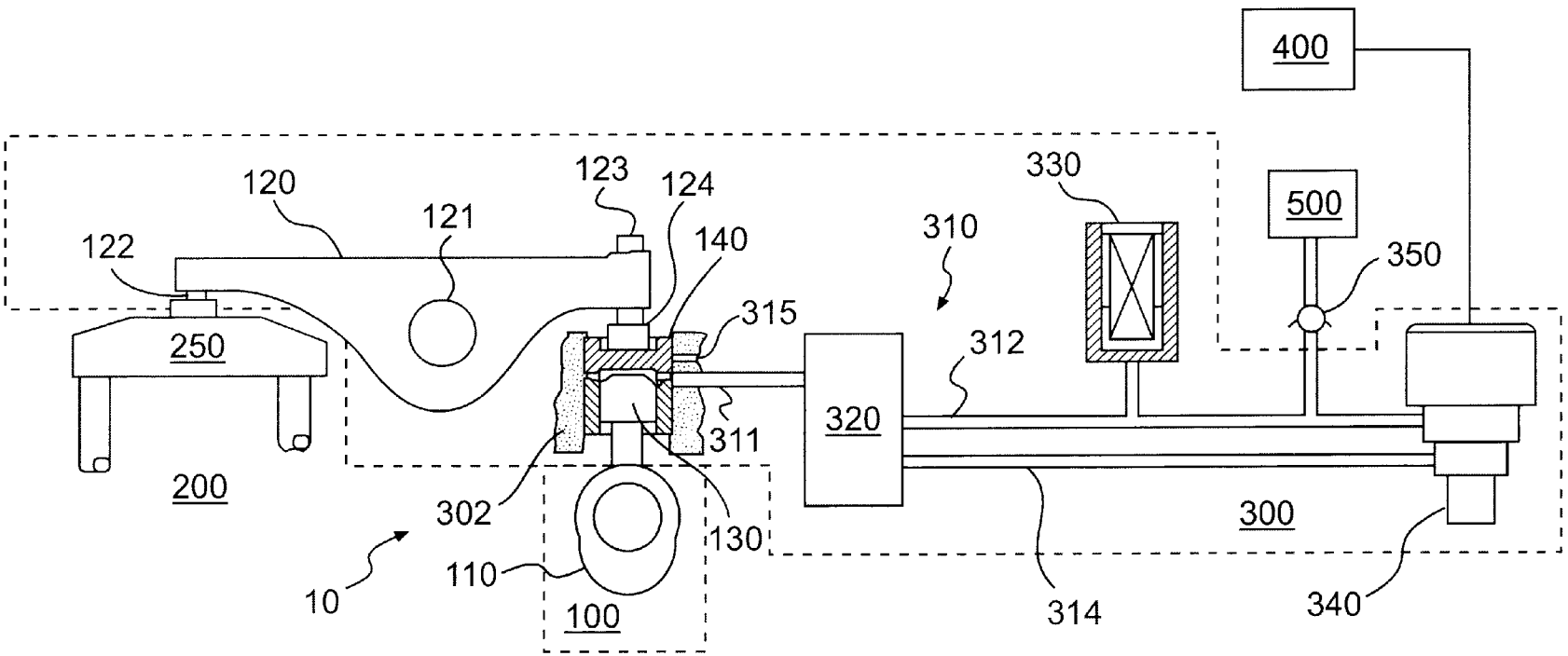
FIG. 2*b* is a schematic diagram of a valve actuation system according to a third embodiment of the present invention.
Figure 4:
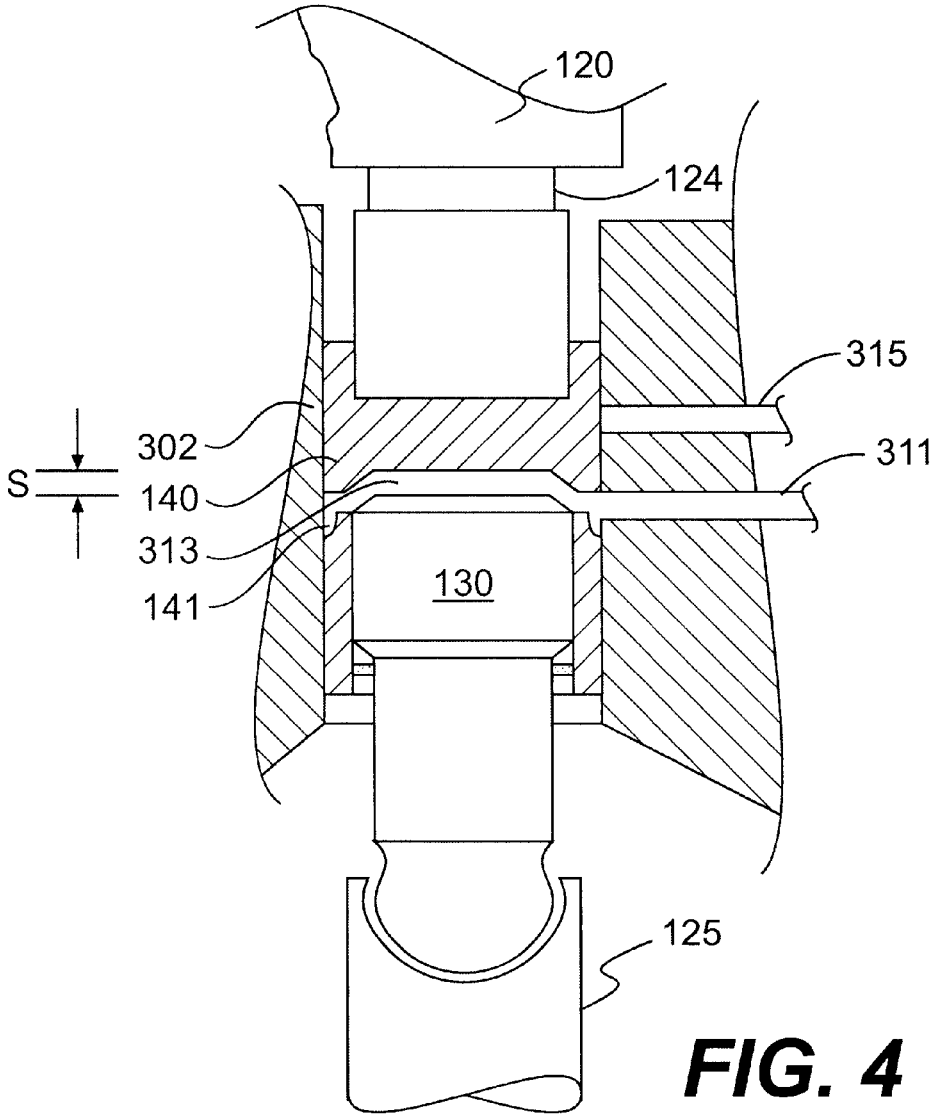
FIG. 4 is a schematic diagram of a master/slave piston assembly according to an embodiment of the present invention.

The master/slave piston assembly 130/140 connects the cam 110 with the rocker 120. One embodiment of the master/slave piston assembly 130/140 of the present invention is shown in FIG. 4. The slave piston assembly 140 may be slidably disposed in a bore formed in the housing 302 such that it may slide back and forth in the bore while maintaining a hydraulic seal with the housing 302. The master piston assembly 130 is adapted to slide relative to the bore, while at the same time forming a seal with the slave piston assembly 140. In the embodiment shown in FIGS. 2*a* and 4, one end of the master piston assembly 130 may be in contact with the push tube 125 to receive the motion from the cam 110. The push tube 125 may include a cam follower, such as, for example, a roller 126, for contacting the surface of the cam 110. Alternatively, as shown in FIG. 2*b*, the valve actuation system 10 may operate without the push tube 125, whereby the cam 110 acts directly on the master piston assembly 130. One end of the slave piston assembly 140 may be in contact with a second end 124 of the rocker 120.

The master/slave piston assembly 130/140 receives hydraulic fluid through a fill passage 311. A fill hole 141 for communicating with the fill passage 311 may be formed in the slave piston assembly 140. When the roller 126 is on the base circle of the cam 110, the master piston assembly 130 is at its lowest position. When no hydraulic fluid is provided between the master piston assembly 130 and the slave piston assembly 140, the master/slave piston assembly is fully collapsed, creating a mechanical link between the master piston assembly 130 and the slave piston assembly 140. The fill passage 311 may be positioned such that, when the roller 126 is on the base circle of the cam 110, as shown in FIG. 4, hydraulic fluid may be selectively supplied to the master/slave piston assembly to create a variable volume gap 313 between the master piston assembly 130 and the slave piston assembly 140. When hydraulic fluid is provided between the master piston assembly 130 and the slave piston assembly 140, the gap 313 has a variable height, s. During positive power operation, fluid may be permitted to pump in and out of the gap 313. This may cushion the motion of the master/slave piston assembly and reduce the overall impact on the valve train. When no hydraulic fluid is in the master/slave piston assembly, the assembly is fully collapsed, and the gap 313 is eliminated (solid condition). This solid condition may be used for cold engine starting when there is not fluid in the master/slave piston assembly 130/140 and for control of valve actuation during positive power.

The height, s, of the gap 313 when the roller is on the base circle of the cam 110 may vary depending on the specification and requirements of the engine and the system 10. In a preferred embodiment, the maximum height of the gap 313 is greater than the magnitude of the engine braking lobe 114 on the cam 110 plus an allowance for system lash and tolerances, but sized such that the full motion of the main event lobe 112 is transferred to the engine valves 200 when the master/slave piston assembly is fully collapsed. The maximum height of the gap 313 may be adjusted by an adjustment means 123, which may adjust the position of the second end 124 of the rocker 120 relative to the slave piston assembly 140.

With continued reference to FIG. 2*a*, the rocker 120 is adapted to actuate the valves 200. The rocker 120 may include a central opening 121 for receipt of a rocker shaft, a first end 122 adapted to contact a valve bridge 250, and a second end 124 adapted to contact the slave piston assembly 140. The rocker 120 is adapted to pivot back and forth about the central opening 121. The first end 122 and the second end 124 may be adapted to allow some pivot motion as the rocker arm 120 contacts the valve bridge 250 and the slave piston assembly 140. A system lash (not shown) may exist between the first end 122 and the valve bridge 250.

As the cam 110 rotates, the roller 126 follows the surface of the cam 110, causing the push tube 125 to displace the master piston assembly 130. Depending on the mode of operation, the hydraulic pressure generated by the master piston assembly 130 may, in turn, displace the slave piston assembly 140, causing the rocker 120 to rotate. As the rocker 120 rotates, the rocker 120 is adapted to actuate the one or more engine valves 200.

The hydraulic circuit 310 may comprise any combination of hydraulic passages adapted to achieve the objects of the system 10. In one embodiment, as shown in FIG. 2*a*, the hydraulic circuit comprises a constant supply passage 312 connecting the master/slave piston assembly 130/140 to the hydraulic fluid supply source 500, a fill passage 311 connecting the master/slave piston assembly 130/140 to the control valve 320 for providing hydraulic fluid to the master/slave piston assembly 130/140, and a low-pressure passage 314 connecting the control valve 320 to the solenoid valve 340 for switching the system to a braking mode of operation. In a preferred embodiment, as shown in FIG. 2*a*, the low-pressure passage 314 is isolated from the constant supply passage 312. This configuration permits the supply of hydraulic fluid to the master/slave piston assembly 130/140 during positive power operation for lubrication and damping while permitting the engine braking mode to be disengaged.

The lost motion system 300 may further comprise means 315 for resetting the length of the lost motion system 300 such that during braking, the engine valves 200 may experience normal valve lift and closing. The reset means 315 is adapted to selectively release fluid from the master/slave piston assembly 130/140 to reset the length of the lost motion system 300. In one embodiment, as shown in FIG. 2*a*, the reset means comprises a hydraulic passage 315 formed in the housing 302. During engine braking, as the roller 126 approaches the main event lobe 112 on the cam 110, the high-pressure hydraulic fluid in the gap 313 between the master piston assembly 130 and the slave piston assembly 140 is released through the reset means 315, causing the master/slave piston assembly 130/140 to collapse (solid condition). The full motion of the main event lobe 112 may then be transferred to the engine valves 200 through the mechanical link between the slave piston assembly 140 and the master piston assembly 130. As such, the reset means 315 may modify the manner in which motion is transferred to the valves 200 from a hydraulic linkage to a mechanical linkage.

In one embodiment, the hydraulic fluid is released to the constant supply passage 312, allowing for quicker refill of the master/slave piston assembly 130/140 during the next engine cycle. It is appreciated, however, that the hydraulic fluid may be released to other parts of the engine, such as, for example, the engine overhead, and/or an oil supply source 500.

Figure 7:
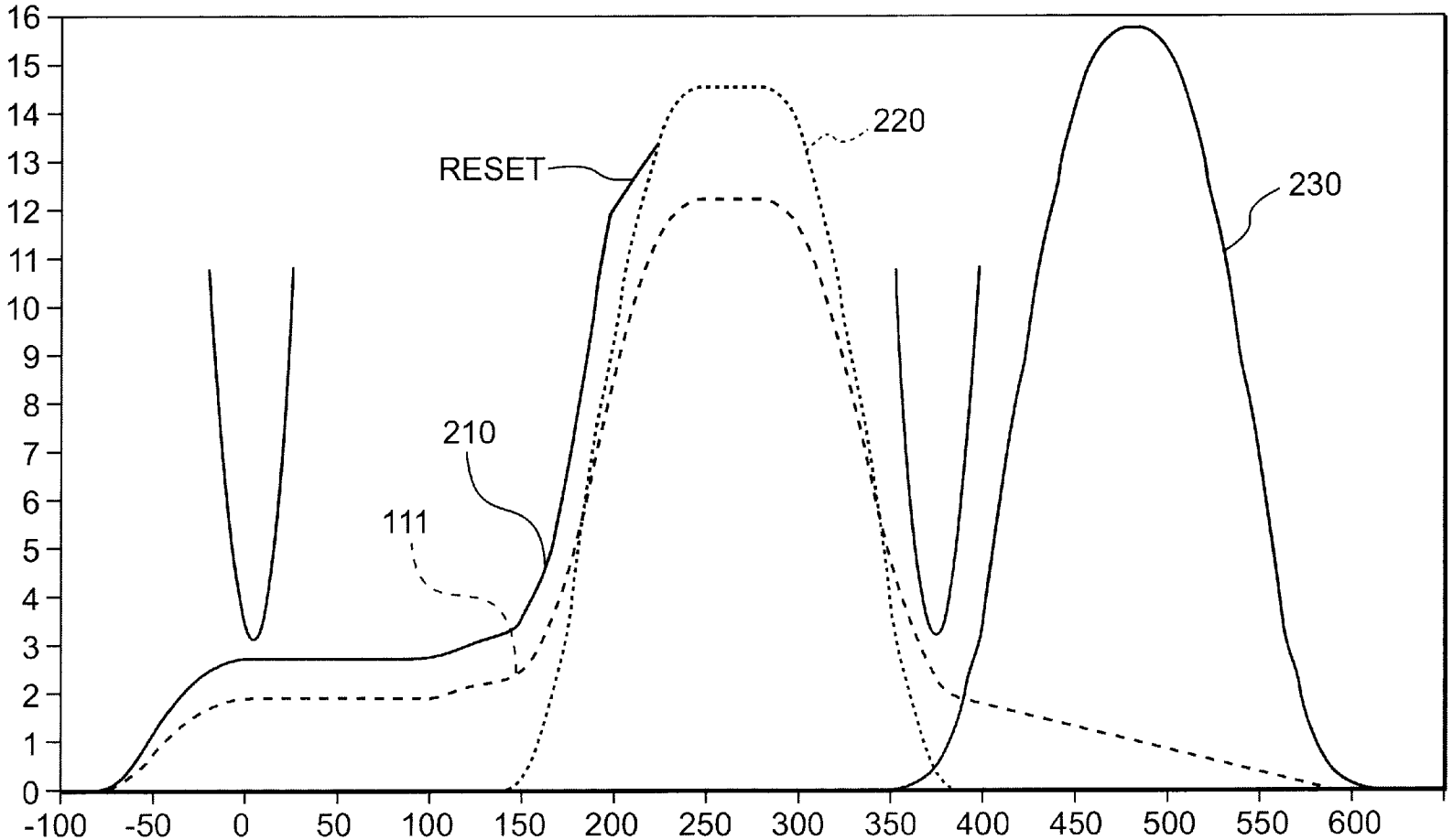
FIG. 7 is a valve lift profile according to an embodiment of the present invention.

During engine braking operation, the system 10 may produce a valve lift profile 210 having an additional lift because the lash in the system may be reduced or fully taken up. As shown in FIG. 7, the release of the hydraulic fluid through the reset means 315 allows the master/slave piston assembly to collapse and the engine valves 200 to follow the remainder of the standard engine valve event, such as, for example, the main exhaust event. FIG. 7 illustrates the cam profile 111, the valve lift profile 210, including the main exhaust event 220 and main intake event 230 profiles, according to one embodiment of the present invention.

The reset means 315 may be sized and positioned such that the reset occurs at any point during the modified valve profile 210. For example, the reset may occur earlier on the main exhaust event 220. The reset means 315 may be positioned based on factors, such as, for example, the desired valve velocity during the reset event, the desired valve acceleration during the reset event, design and production tolerances, and/or other design considerations. Preferably, the reset means 315 is positioned such that the reset occurs when the engine valves 200 have a reduced velocity and acceleration.

Figure 5:
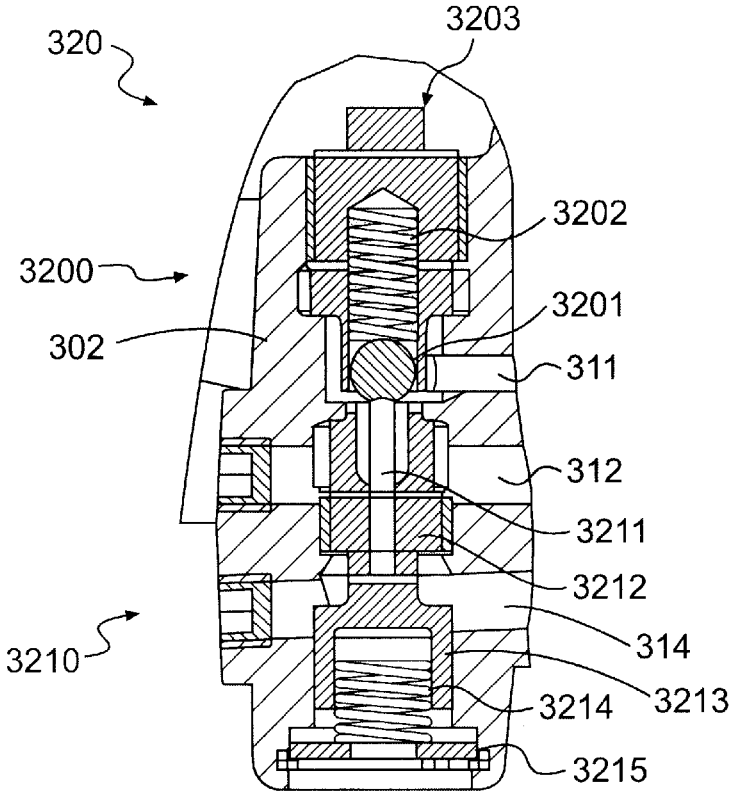
FIG. 5 is a schematic diagram of a control valve according to an embodiment of the present invention.

The control valve 320 may be disposed in a bore formed in the housing 302. The control valve 320 is adapted to control the flow of hydraulic fluid to the master/slave piston assembly. In one embodiment of the present invention, as shown in FIG. 5, the control valve 320 includes a check valve assembly 3200 and a control pin assembly 3210. The check valve assembly 3200 may comprise a ball 3201 in contact with a spring 3202. The spring 3202 is in contact with a screw assembly 3203, which secures the check valve 3200 to the housing 302. The control pin assembly 3210 may comprise a base 3215 secured to the housing 302, a control piston 3213, and a spring 3214 having a first end in contact with the base 3215 and a second end in contact with the control piston 3213. The control pin assembly 3210 may further comprise a pin 3211 having a first end in contact with the control piston 3213 and a second end in contact with the ball 3201. The pin 3211 is free to slide within a pin guide 3212.

The spring 3214 is biased such that, absent fluid pressure from the low-pressure supply passage 314, the pin 3211 is forced against the ball 3201 by the control piston 3214, keeping the ball 3201 off its seat (pin guide) 3212. When fluid pressure is supplied to the low-pressure supply passage 314, for example to initiate engine braking, the fluid pressure acts on the control piston 3213 and against the bias of the spring 3214. This, in turn, causes downward translation of the pin 3211 within the pin guide 3212 and seating of the ball 3201 on its seat (pin guide) 3212. At this point, the ball 3201 prevents backward fluid flow to the constant supply passage 312 such that fluid is trapped in the fill passage 311.

Figure 6:
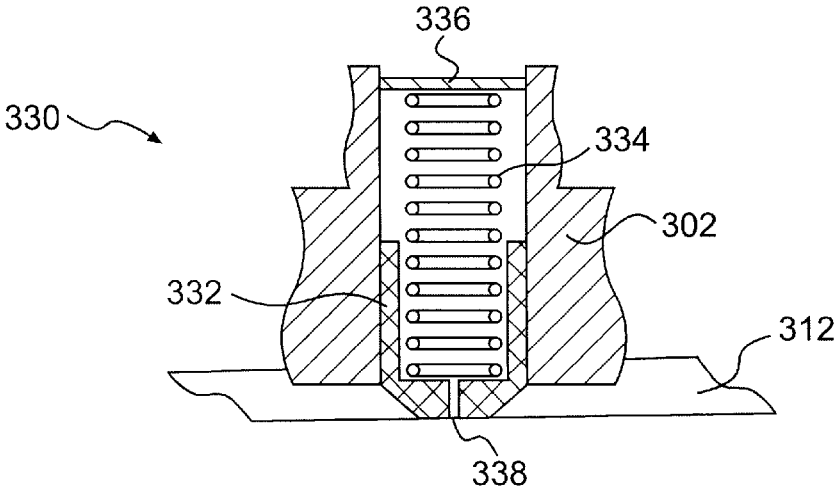
FIG. 6 is a schematic diagram of an accumulator according to an embodiment of the present invention.

The accumulator 330 is located in a bore formed in the housing 302, and is adapted to absorb motion transferred by the motion imparting means 100. In one embodiment of the present invention, as shown in FIG. 6, the accumulator 330 may comprise an accumulator piston 332, and a spring 334 having a first end in contact with a base 336 and a second end in contact with the accumulator piston 332. The accumulator piston 332 is adapted to slide within its bore in the housing 302. Until braking is initiated, the accumulator 330 is in full communication with the master/slave piston assembly through the constant supply passage 312 and the fill passage 311. This allows hydraulic fluid in the fill passage 311 and the constant supply passage 312 to be pumped back and forth between the master/slave piston assembly 130/140 and the accumulator 330, thereby causing selected valve events on the cam 110, or portions thereof, to be lost.

In one embodiment of the present invention, as shown in FIG. 6, the accumulator 330 further includes a bleed hole 338 formed in the accumulator piston 332. The bleed hole 338 permits hydraulic fluid to slowly leak from the constant supply passage 312 to an oil supply source 500, such as, for example, a sump. The slow leakage of hydraulic fluid from the valve actuation system 10 may be steadily replenished by cooler hydraulic fluid from a localized low pressure source of hydraulic fluid in communication with the hydraulic circuit 310. This cooling effect may prevent the valve actuation system 10 from exceeding temperature limits. The local source of hydraulic fluid may communicate with the hydraulic circuit 310 through a check valve 350. This local source of hydraulic fluid could also be used to charge the hydraulic circuit 310 with fluid upon cold start. It is appreciated that this local reservoir of hydraulic fluid may be integrated into the housing 302.

The lost motion system 300 may include a solenoid valve 340. The solenoid valve 340 may include an internal plunger (not shown) that is spring biased into a closed or opened position. The bias of the spring determines whether the solenoid valve 340 is normally open, or normally closed. Embodiments of the present invention may use either a normally open or a normally closed solenoid valve 340. If the solenoid valve 340 is normally closed, for example, it will prevent the release of hydraulic fluid to the low-pressure passage 314 until it is activated by the control means 400 and opened. In a preferred embodiment, the solenoid valve 340 is a low-speed valve.

With reference to FIG. 2*a*, operation of an embodiment of the system 10 during lost motion mode (e.g., non-braking) will now be described. Hydraulic fluid from the supply source 500 enters the hydraulic circuit 310 through the check valve 350 and fills the constant supply passage 312. The solenoid valve 340 remains closed, preventing hydraulic fluid supply to the low-pressure passage 314. The ball 3201 remains unseated by the pin 3211, allowing hydraulic fluid to flow from the constant supply passage 312 to the fill passage 311. Until the engine braking mode is initiated, the fill passage 311 remains in communication with the constant supply passage 312. This permits hydraulic fluid to be pumped back and forth between the master/slave piston assembly 130/140 and the accumulator 330. As the cam 110 rotates, the hydraulic pressure generated by the upward translation of the master piston assembly 130 may be absorbed by the accumulator 330 without transferring the motion of the engine braking lobe 114 to the slave piston assembly 140, the rocker 120, and, ultimately the valves 200. As the cam 110 approaches the main event lobe 112, the remaining fluid in the master/slave piston assembly 130/140 is pumped out and the master piston assembly 130 comes into contact with the slave piston assembly 140, forming a mechanical link. The full motion of the main event lobe 112 is then transferred to the engine valves 200.

When motion transfer is required, the control means 400 transmits a signal to the trigger valve 340, causing it to open and hydraulic fluid to fill the low-pressure passage 314. The pressure in the passage 314 displaces the control piston 3213, causing the downward translation of the pin 3211 and the seating of the ball 3201. At this point, the ball 3201 seals the constant supply passage 312 such that fluid is trapped in the fill passage 311. When the cam 110 is on the base circle, the slave piston assembly 140 blocks the reset passage 315. This prevents hydraulic fluid from releasing from the master/slave piston assembly. The master/slave piston assembly 130/140 is now hydraulically locked and the motion from the engine braking lobe 114 is transferred to the valves 200. As the cam 110 continues to rotate, approaching the main exhaust lobe 112, the slave piston assembly 140 is positioned such that the reset passage 315 is exposed. This allows hydraulic fluid in the master/slave piston assembly 130/140 to be pumped back to the constant supply passage 312, or elsewhere, as discussed above, and the master/slave piston assembly to collapse. The collapsing of the master/slave piston assembly 130/140 allows the valves 200 to follow the remainder of the standard main event, without any increase in overall valve lift or change to the exhaust valve closing. When the cam 110 returns to base circle, the master/slave piston assembly refills with hydraulic fluid. If refill or make-up hydraulic fluid is required by the master/slave piston assembly, the pressure in the fill passage 311 will be lower than the pressure in the constant supply passage 312. The ball 3201 will be unseated due to the pressure differential and hydraulic fluid will be permitted into the fill passage 311 and the master/slave piston assembly. The ball 3201 will reseat once the fill passage 311 and the master/slave piston assembly are full, or once the pressure in the fill passage 311 is greater than the pressure in the constant supply passage 312.

When engine braking is no longer required, the trigger valve 340 receives a signal from the control means 400 to turn off and close. The hydraulic fluid in the low-pressure. passage 314 is dumped, causing the control piston 3213 to return to its original position. This allows the system 10 to return to lost motion mode (e.g., positive power operation).

It will be apparent to those skilled in the art that variations and modifications of the present invention can be made without departing from the scope or spirit of the invention. For example, the system may be adapted to actuate a single engine valve without use of the valve bridge 250. The location of the reset on the valve profile may vary by modifying the size and/or position of the reset means 315. In addition, the solenoid valve 340 may be a high-pressure solenoid valve, which would allow several other components to be removed from the system. Thus, it is intended that the present invention cover all such modifications and variations of the invention, provided they come within the scope of the appended claims and their equivalents.

What is claimed is:

1. In an internal combustion engine, a system for actuating one or more engine valves, said system comprising:

a lost motion subsystem operatively connected to the engine valve;

a hydraulic fluid supply in communication with said lost motion subsystem; and means for imparting motion to said lost motion subsystem, wherein said lost motion subsystem comprises:

a housing having an internal bore;

a piston assembly slidably disposed in the bore, said piston assembly comprising a master piston and a slave piston;

a hydraulic control valve;

a solenoid actuated hydraulic fluid valve;

a first hydraulic passage connecting said control valve to said piston assembly;

a second hydraulic passage connecting said fluid supply to said control valve; and a third hydraulic passage connecting said solenoid valve to said control valve.

2. The system of claim 1, wherein said control valve comprises:

a check valve assembly disposed between said first hydraulic passage and said second hydraulic passage; and a control pin assembly disposed between said check valve assembly and said second hydraulic passage.

3. The system of claim 2, wherein said check valve assembly further comprises:

a screw assembly adapted to secure said check valve assembly to said housing;

a check valve spring in contact with said screw assembly; and a ball in contact with said check valve spring.

4. The system of claim 3, wherein said control pin assembly further comprises:

a base secured to said housing;

a control piston;

a piston spring having a first end in contact with said base and a second end in contact with said control piston;

a pin slidably disposed in a pin guide, said pin having a first end in contact with said control piston and a second end in contact with said ball.

5. The system of claim 1, further comprising a fluid release passage formed within said housing in selective communication with said piston assembly.

6. The system of claim 5, said release passage connecting said piston assembly to said second hydraulic passage.

7. The system of claim 1, wherein said motion imparting means further comprises:

a cam having a plurality of lobes for producing at least one main event valve actuation and at least one auxiliary event valve actuation; and a push tube having a first end in contact with said cam and a second end in contact with the master piston.

8. The system of claim 1, wherein said lost motion subsystem further comprises:

a valve bridge in contact with the engine valve; and a rocker having a first end in contact with said piston assembly and a second end adapted to contact said valve bridge.

9. The system of claim 1, wherein said lost motion subsystem further comprises an accumulator in communication with said second hydraulic passage.

10. The system of claim 9, wherein said accumulator comprises:

a base secured to said housing;

an accumulator piston slidably disposed in a bore formed in said housing; and a spring having a first end in contact with said base and a second end in contact with said accumulator piston.

11. The system of claim 10, further comprising a bleed hole formed in said accumulator piston adapted to permit fluid leakage from said second hydraulic passage to said fluid supply.

12. The system of claim 1, wherein said solenoid valve comprises a low speed solenoid valve.

13. The system of claim 1, further comprising a controller in communication with said lost motion subsystem adapted to selectively switch said lost motion subsystem between a first operating mode and a second operating mode.

14. In an internal combustion engine having an engine rocker arm, a hydraulic passage, and a control valve having a check valve assembly and a control pin assembly disposed between the check valve assembly and the hydraulic passage, a method of actuating an engine valve during first and second operating modes to produce a main event valve actuation and to selectively produce an auxiliary event valve actuation using motion imparted to a lost motion subsystem, said method comprising the steps of:

supplying hydraulic pressure to the lost motion subsystem;

during the first operating mode, selectively absorbing at least a portion of the hydraulic pressure applied to the lost motion subsystem so as to selectively lose a portion of the motion imparted thereto; and during the second operating mode, providing low-pressure hydraulic fluid to the control valve, imparting motion to the rocker arm through a hydraulic lock in the lost motion subsystem and selectively resetting the length of the lost motion subsystem.

15. In an internal combustion engine, an engine valve actuation system adapted to switch between first and second operating modes for providing main event valve actuations and selectively providing auxiliary event valve actuations, said system comprising:

a housing having an internal bore;

a piston assembly slidably disposed in the bore, said piston assembly comprising a master piston and a slave piston;

means for imparting motion to said piston assembly;

means for controlling the supply of hydraulic fluid to the piston assembly;

a first passage connecting said control means to said piston assembly for providing hydraulic fluid to the piston assembly during the first and second operating modes;

a second passage connecting the control means to a supply source for receiving a constant supply of hydraulic fluid; and a third passage connected to said control means for providing low-pressure hydraulic fluid to said control means to switch to the second operating mode.

16. The system of claim 15, wherein said motion imparting means comprises a cam in contact with said piston assembly, said cam having a plurality of lobes for producing the main event valve actuation and the auxiliary event valve actuation.

17. The system of claim 15, wherein said motion imparting means comprises:

a cam having a plurality of lobes for producing the main event valve actuation and the auxiliary event valve actuation; and a push tube having a first end in contact with said cam and a second end in contact with the master piston.

18. The system of claim 15, further comprising means for releasing hydraulic fluid from said piston assembly during said second operating mode.

19. The system of claim 18, wherein said fluid release means comprises a fluid release passage formed within said housing.

20. The system of claim 19, wherein said fluid release means is adapted to release fluid from said piston assembly to said second passage.

21. A system for actuating one or more engine valves adapted to switch between a first operating mode for providing a main event valve actuation and a second operating mode for selectively providing an auxiliary event valve actuation, said system comprising:

a housing having an internal bore;

a piston assembly slidably disposed in the bore, said piston assembly comprising a master piston and a slave piston;

means for imparting motion to said piston assembly;

a control valve; and a hydraulic passage connected to said control valve for providing low-pressure hydraulic fluid to the control valve and enabling the second operating mode, wherein said control valve comprises:

a check valve assembly; and a control pin assembly disposed between said check valve assembly and said hydraulic passage.

22. The system of claim 21, further comprising means for releasing hydraulic fluid from said piston assembly during the second operating mode.

23. The system of claim 21, further comprising a solenoid actuated hydraulic fluid valve in communication with said hydraulic passage.

* * * * *